United States Patent [19]

Tidwell

[11] Patent Number: 4,911,575

[45] Date of Patent: Mar. 27, 1990

[54] POWER TROWEL CONTROL DEVICE

[76] Inventor: Robert L. Tidwell, 15785 Mission St., Hesperia, Calif. 92345

[21] Appl. No.: 399,760

[22] Filed: Aug. 29, 1989

Related U.S. Application Data

[63] Continuation of Ser. No. 97,578, Sep. 17, 1987, abandoned.

[51] Int. Cl.[4] ..... E01C 19/22; E01G 21/10

[52] U.S. Cl. ..... 404/97; 404/112; 404/131; 16/114 R

[58] Field of Search ..... 404/97, 112, 131; 16/114 R, 114 A, 115

[56] References Cited

U.S. PATENT DOCUMENTS

| | | | |
|---|---|---|---|
| 758,482 | 4/1904 | Smith | 16/114 R |
| 1,503,348 | 7/1924 | Bruhn | 16/114 R |
| 2,244,585 | 6/1941 | Tweit | 16/114 R |
| 2,673,396 | 3/1954 | Beres | 16/111 A |
| 2,826,972 | 3/1958 | Stevens | 404/112 |
| 3,007,379 | 11/1961 | Ellis | 404/131 |
| 3,068,765 | 12/1962 | Caufield | 404/131 |
| 3,080,800 | 3/1963 | Malzahn | 404/131 |
| 3,120,159 | 2/1964 | White | 404/131 |
| 3,130,444 | 4/1964 | Stollsteimer | 16/111 A |
| 3,791,754 | 2/1974 | Zochil | 404/112 |
| 4,046,483 | 9/1977 | Sutherland | 404/112 |
| 4,050,728 | 9/1977 | Davidson | 16/114 R |
| 4,615,553 | 10/1986 | Hultine | 16/115 |

*Primary Examiner*—Stephen J. Novosad
*Assistant Examiner*—Gay Ann Spahn
*Attorney, Agent, or Firm*—Bernard L. Kleinke; William P. Waters; Jerry R. Potts

[57] ABSTRACT

A control device which is fixed to the control arm of a concrete pwer trowel or concrete finishing machine approximately midway between the trowel and the trowel handle. The attachment, which is adjustable in length, relieves the operator from the necessity of controlling the power trowel by means of its handle and allows the operator to control the power trowel from various distances outside the perimeter of the poured concrete.

4 Claims, 1 Drawing Sheet

POWER TROWEL CONTROL DEVICE

This is a continuation of application Ser. No. 07/097,578, filed on 09/17/87, now abandoned.

BACKGROUND OF THE PRESENT INVENTION

The present invention relates generally to concrete power trowel (finishing machine control devices and more particularly to an adjustable attachment which, when fixed to the control arm of a concrete power trowel, permits its operator to move and control the trowel from various distances outside the perimeter of the poured concrete.

In both residential and commercial property development, it is common for the developer to have large areas covered with concrete simultaneously in order to obtain a seamless surface and to provude a strong, uniform foundation on which to build. After the concrete has been poured, it is customary to rough trowel it in order to produce an initially smooth surface. As the concrete "sets up" or hardens, it becomes necessary to trowel the surface more carefully in order to produce the uniformly smooth, seamless surface generally seen in finished concrete surfaces.

The final trowelling of concrete surfaces, when a large area has been poured, is generally accomplished by means of a power trowel. This is usually a gasoline driven machine which rotates one or more trowels over the concrete to be smoothed. Movement of the power trowelis controlled by an operating arm, approximately four feet in length, which extends from the base of the machine at an angle of approximately 45 degrees. The arm generally has opposed handles at its proximal end which are held by an operator during use and which are utilized to maneuver the power trowel over the concrete being finished.

A serious deficiency presented by conventional use of the above described power trowel is the necessity for its operator to walk in close relation to it. In use, this requirement results in the production of the operator's footprints in the concrete. Because of this problem, the power trowel is generally operated so as to be pulled by the operator over the operator's own footprints. In fact, a significant amount of any power trowelling operation is involved in the attempt to smooth over the footprints of the power trowel operator. The present invention, because it enables the operator to perform the trowelling operation from beyond the perimeter of the poured concrete, produces a flatter surface because of the elimination of footprints.

In addition to the problem of footprints produced during conventional power trowel operations, an important economic consideration is also involved. Because of the fact that the operator must walk across the concrete in the process of power trowelling, it is necessary for the operator to delay commencement of power trowelling until some time after the concrete has been poured. The time thus lost contributes significantly to construction costs.

Although the above described deficiencies have been well recognized in the prior art, no invention has been found in the prior art which can enable the power trowel operator to operate and control a power trowel at a distance from the trowel and from a point of vantage removed from the surface of the newly poured concrete. Thus, there is a substantial need in the art for a reliable, low-cost device and method which permit operation of a concrete power trowel by an operator who is not standing on the concrete being trowelled and who can control the power trowel from a distance.

OBJECTS AND SUMMARY OF THE PRESENT INVENTION

It is an object of the present invention to provide a power trowel attachment which is low in cost and is adaptable to a broad range of user applications.

It is a further object of the present invention to provide a power trowel control device which enables an operator to finish concrete without walking on the slab, thereby eliminating footprints.

It is a still further object of the present invention to provide a power trowel control device which is easily assembled and used.

It is a still further object of the present inveniton to provide a power trowel control device which reduces the time necessary to finish trowel concrete.

The present invention specifically addresses and alleviates the above described deficiencies found in the art and comprises an invention and method for controlling a concrete power trowel by an operator who is at a distance from the power trowel. More particularly, the present invention comprises an attachment member having control handles at one end and which is attached to the control arm, approximately at its mid-point in length, of a power trowel.

The length of the attachment member between the operator and the power trowel may be fixed or, on the other hand, it may be adjustable. In operation, it has been found that extension members of varying lengths may be placed between the handles of the invention and its point of attachment to the power trowel, thereby providing flexibility in the utilization of the invention.

DESCRIPTION OF THE DRAWINGS

These as well as other features of the present invention will become more apparent upon reference to the drawings wherein.

DETAILED EMBODIMENT OF THE PRESENT INVENTION

Figure 1:
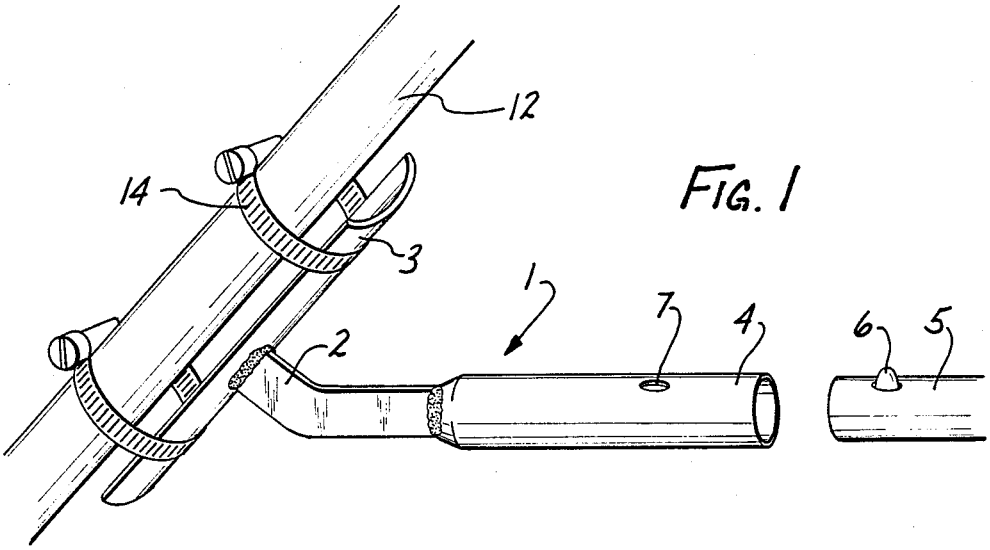
FIG. 1 is a partial side elevational view of the attachment means of the present invention depicted in separated relationship to a concrete power trowel handle.

Referring to FIG. 1, there is shown the elements of the present invention comprised generally of attachment member 1 comprised of a barrel 4, a neck 2 and an arcuate mounting plate 3. In use, the mounting plate 3 is attached at approximately the mid-point along the length of power trowel control arm 12. In its preferred embodiment, the present invention utilizes an angle at neck 2 so that the invention extends upwardly from control arm 12 at an angle to the horizontal of approximatley 22 degrees. In FIG. 1, mounting plate 3 is depicted in separated relationship to power trowel control arm 12. In use, the mounting plate is securely attached to said control arm by one of several attachment means. While attachment means 14, may be comprised of conventional hose clamps, it will be readily apparent to one skilled in the art that other, readily available attachment means may be utilized without impairing the utility of the present invention. In fact, it would be within the scope of the present invention if the attachment member 1 were to be permanently fixed to control arm 12.

With further reference to FIG. 1, attachment member 1, at its end opposite its attachment point to control arm 12, has barrel 4 in which is located aperture 7. The length of the present invention can be varied by insertion of one or more of extension members 5 into barrel 4. Extension member 5 may be removably attached to barrel 4 by means of button 6 which is springedly attached to the interior of extension member 5 and which extends into aperture 7 when extension member 5 is inserted into barrel 4.

Figure 2:
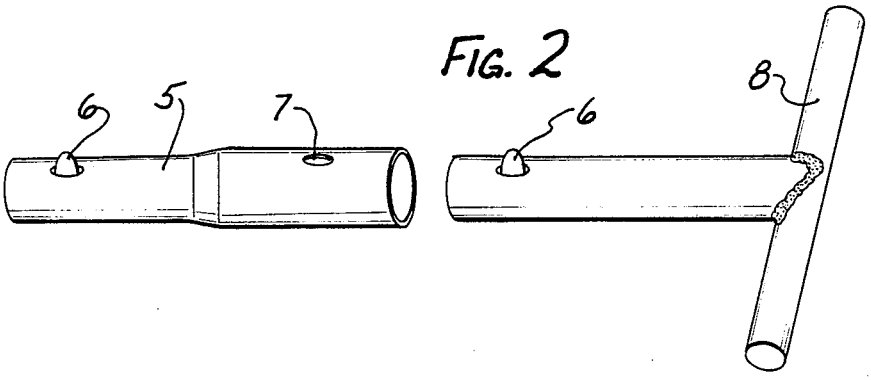
FIG. 2 is a plan view of the handle and of an extension member of the present invention depicted in separated relationship to each other.

FIG. 2 depicts the relationship between extension member 5 and handle assembly 8. The manner of attachment of extension tube 5 to handle assembly 8, utilizes button 6 and aperture 7 as previously discussed.

Figure 3:
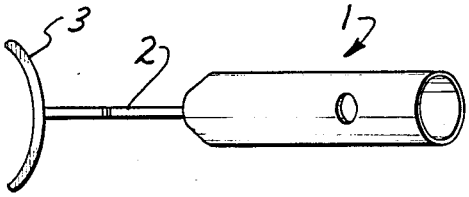
FIG. 3 is a top view of the attachment member, the neck and the mounting plate of the invention.

FIG. 3 depicts the connection through neck 2 of attachment member 1 and mounting plate 3. Mounting plate 3 is depicted as arcuate in shape since in the preffered embodiment of the present invention, this shape permits a secure means for attachment to the power trowel control arm. It is readily apparent to one skilled in the art that other means of attaching attachment member 1 to the control arm may be utilized without limiting the disclosure and the claims herein.

While in its preferred embodiment, the present invention is constructed of metal and handle, extension tubes and barrel are cylinderical in cross section, such features are not intended as limitations of the invention.

In summary, the present invention comprises a power trowel control device which is inexpensive to produce, adaptable to various applications by virtue of its adjustability, which saves time in the finishing of concrete and which provides a method of finishing concrete wherein the problem of operator footprints has been eliminated.

I claim:

1. A control device of an upstanding power tool control arm, having a first length and extending at a first angle inclined from the plane of a surface to be processed, comprising:

elongated handle means for helping control the movement of the control arm over the surface at a great distance therefrom, said handle means being of a second length, said second length being substantially greater than the first length;

securing means for rigidly fixing one end of said handle means to the underside of said control arm to position said handle means at a second angle inclined from the plane of the surface, said first angle being greater than said second angle, said securing means including an arcuate mounting plate, fixedly attached to one end of said handle means for receiving the underside of the control arm;

a neck ridgedly connecting to said handle means and said mounting plate to define said second angle, and attachment means for connecting releaseably said mounting plate to said power tool control arm, and said handle means including a first barrel fixed at one end to neck, and a second barrel detachably connected to said first barrel.

2. A control device of claim 1, wherein said second angle is approximately 22°.

3. A control device of claim 1, wherein said attachment means is at least one hose clamp.

4. A method of processing a surface, using a power trowel having a power tool control arm, comprising:

fixing the control device of claim 5 rigidly to the underside of the power tool control arm;

standing apart from the surface being processed;

maintaining said control device at an angle to the surface being processed of approximately 22 degrees to provide clearance space over objects extending upwardly from said surface; and reciprocatively swinging the control device internally to cause the power tool control arm to move relative to the surface for processing it.

* * * * *

UNITED STATES PATENT AND TRADEMARK OFFICE

CERTIFICATE OF CORRECTION

PATENT NO. : 4,911,575

DATED : March 27, 1990

INVENTOR(S) : Robert L. Tidwell

It is certified that error appears in the above-identified patent and that said Letters Patent is hereby corrected as shown below:

On the title page:

In the abstract, line 2, after "concrete", delete "pwer", and substitute therefor --power--.

Column 1, line 9, after "machine", insert --)--.

Column 1, line 18, delete "provude", and substitute therefor --produce--.

Column 2, line 17, after "present", delete "inveniton", and substitute --invention--.

Column 2, line 61, delete "approximatley"

Column 3, line 39, after "device", delete "of" and substitute --for--.

Signed and Sealed this

Twenty-fifth Day of August, 1992

*Attest:*

DOUGLAS B. COMER

*Attesting Officer*

*Acting Commissioner of Patents and Trademarks*